US011662189B2

(12) United States Patent
Chambers

(10) Patent No.: US 11,662,189 B2
(45) Date of Patent: May 30, 2023

(54) SOUND AND TIME STAMP COMPARISON METHOD FOR ENABLING SHORT RANGE EXPLOSIVE DEVICE TRAINING SIMULATORS

(71) Applicant: Serious Simulations, LLC, Orlando, FL (US)

(72) Inventor: Christopher Chambers, Orlando, FL (US)

(73) Assignee: Serious Simulations, Inc., Orlando, FL (US)

( * ) Notice: Subject to any disclaimer, the term of this patent is extended or adjusted under 35 U.S.C. 154(b) by 0 days.

(21) Appl. No.: 16/926,639

(22) Filed: Jul. 10, 2020

(65) Prior Publication Data

US 2021/0108902 A1 Apr. 15, 2021

Related U.S. Application Data

(60) Provisional application No. 62/872,596, filed on Jul. 10, 2019.

(51) Int. Cl.
*F42B 8/26* (2006.01)
*F41A 33/04* (2006.01)

(52) U.S. Cl.
CPC ..... *F42B 8/26* (2013.01); *F41A 33/04* (2013.01)

(58) Field of Classification Search
CPC .... F42B 8/26; F42B 8/00; F42B 12/42; F41A 33/04; F41H 9/06
USPC ..... 102/498, 482, 502, 513, 276, 395; 434/11, 16, 18, 19
See application file for complete search history.

(56) References Cited

U.S. PATENT DOCUMENTS 5,351,623 A * 10/1994 Kissel ..... F42B 8/26 102/498
5,788,500 A * 8/1998 Gerber ..... F41G 3/2666 102/355
6,604,946 B2 * 8/2003 Oakes ..... F42B 12/365 102/444
7,976,309 B1 * 7/2011 Jones ..... F41G 3/2622 434/21
8,523,185 B1 * 9/2013 Gilbreath ..... F41J 5/06 273/371
9,234,730 B1 * 1/2016 Cook ..... F42C 11/065
9,500,425 B1 * 11/2016 Lawrence ..... F41A 17/08
2006/0230972 A1 * 10/2006 Ouliarin ..... F42B 30/04 102/487
2008/0216699 A1 * 9/2008 McAleer ..... F42B 8/26 102/367

(Continued)

*Primary Examiner* — John Cooper
(74) *Attorney, Agent, or Firm* — Maxwell L. Minch; Maxwell L Minch Esq. PA

(57) ABSTRACT

The present invention provides for a network connected training projectile that provides user feedback and is used to determine a trainee's proximity to an appropriately sized explosive blast zone. The invention solves the unmet need for close combat indirect fire (mortars and grenade launchers), or hand grenades which can be safely used in live training exercises. The invention further solves that such use is interactive with the training environment providing the ability to calculate the extent personnel participating in a training exercise would be affected by the training grenade in a real-life scenario. The invention further determines mortality of participants who would have been affected by the training grenade.

11 Claims, 3 Drawing Sheets

(56) References Cited

U.S. PATENT DOCUMENTS

| | | | | |
|---|---|---|---|---|
| 2010/0058947 | A1* | 3/2010 | Davis | F42B 8/26 102/498 |
| 2010/0072895 | A1* | 3/2010 | Glynn | F41H 13/0081 315/209 T |
| 2010/0282109 | A1* | 11/2010 | Caldwell | F42B 8/28 102/367 |
| 2011/0048271 | A1* | 3/2011 | Colon | F41H 9/06 102/498 |
| 2011/0311949 | A1* | 12/2011 | Preston | F41G 3/2666 434/16 |
| 2012/0247359 | A1* | 10/2012 | Brunn | F42B 27/00 102/334 |
| 2015/0084281 | A1* | 3/2015 | Miller | F41J 5/06 273/371 |
| 2015/0128823 | A1* | 5/2015 | Akcasu | F42B 12/365 102/517 |
| 2016/0073206 | A1* | 3/2016 | Zirkind | G09B 5/04 381/66 |
| 2018/0071645 | A1* | 3/2018 | Hugill | G10K 15/043 |
| 2018/0080748 | A1* | 3/2018 | Sotola | F42B 8/26 |
| 2018/0364006 | A1* | 12/2018 | Reymann | G01R 33/072 |
| 2019/0281259 | A1* | 9/2019 | Palazzolo | H04L 9/0643 |
| 2019/0301843 | A1* | 10/2019 | Hammond | F42B 8/00 |
| 2020/0134852 | A1* | 4/2020 | Mercier | G01S 5/14 |

* cited by examiner

M67 fragmentation grenade.

SOUND AND TIME STAMP COMPARISON METHOD FOR ENABLING SHORT RANGE EXPLOSIVE DEVICE TRAINING SIMULATORS

CROSS-REFERENCE TO RELATED APPLICATIONS

This application claims the benefit of U.S. Provisional Application No. 62/872,596, having a filing date of Jul. 10, 2019, the disclosure of which is hereby incorporated by reference in its entirety and all commonly owned.

FIELD OF THE INVENTION

The present invention pertains to projectiles and more particularly to network connected training projectiles, grenades, and mines for use in a training environment emitting sounds, radio transmissions, light, and time stamped data. The present invention further pertains to systems using sound and/or radio projectiles and sound and/or radio receivers to determine a user's proximity to a simulated blast zone of the training projectile/grenade/mine.

BACKGROUND OF THE INVENTION

Current training for hand grenade employment is conducted with inert replica training grenades against non-human targets, and provides limited auditory feedback. The training grenades are designed to simulate the look and feel of real grenades to allow a user become accustomed to the weight and operation of a grenade. However, when thrown, there is virtually no user feedback. Moreover, it is difficult to determine whether trainees are within the blast radius of the training grenade if used within a training environment, other than through human estimation.

In modern networked training exercises with live human participants, there is still no solution for employment of hand grenades, which greatly limits the effectiveness of training by eliminating an important battlefield weapon system. In addition, there is no effective solution for simulating the effects of various types of mines, other than exercise controllers subjectively accruing training casualties when auditory or smoke based mine simulators are initiated in an exercise. Similarly, the limited replication of grenade launchers and mortars, consists of human exercise controllers who use experience and guesswork to manually assess and assign casualties during the events. Thus there remains an unmet important military training need for a network connected training device for the employment of grenades/mines/projectiles anywhere and anytime in an exercise, such that it provides immediate user feedback and can be used to determine a trainee's proximity to a blast zone. In addition there remains an unmet need that provides for a system which includes a training grenade (or training land mine, or scatterable mine, or improvised explosive device) and sensors that allow for the calculation of a trainee's position relative to a blast zone in a training environment, to realistically assess battlefield casualties.

There is currently no method by which close combat indirect fire (mortars and grenade launchers), or hand grenades can be safely used in live training exercises. Concerns for the safety of personnel from thrown or launched objects, and reliable feedback for trainees who might be located in the relatively small wound producing blast areas of these limited scale explosives has hampered the development of an appropriate training device.

SUMMARY OF THE INVENTION

The present invention provides for a network connected training projectile that provides user feedback and is used to determine a trainee's proximity to an appropriately sized explosive blast zone.

One aspect of the present invention includes a sound (audible or ultrasonic) and/or radio projectile that when initiated will initiate a sound and/or radio event. Another aspect is that when initiated the projectile will generate and transmit time stamped data or time stamp or other time descriptor data upon receipt at the receiver.

Another aspect of the invention involves a system using the sound projectile and data emission to one or more networked receivers, carried by individuals or vehicles or equipment, which are used in determining the proximity of the receivers to a simulated blast zone in proximity to the detonated sound projectile.

This summary is provided to introduce a selection of concepts in a simplified form that are further described below in the Detailed Description. The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

Examples illustrative of embodiments of the disclosure are described below with reference to figures attached hereto. In the figures, identical structures, elements or parts that appear in more than one figure are generally labeled with the same numeral in all the figures in which they appear. Dimensions of components and features shown in the figures are generally chosen for convenience and clarity of presentation and are not necessarily shown to scale. Many of the figures presented are in the form of schematic illustrations and, as such, certain elements may be drawn greatly simplified or not-to-scale, for illustrative clarity. The figures are not intended to be production drawings. The figures (Figs.) are listed below.

Figure 1:
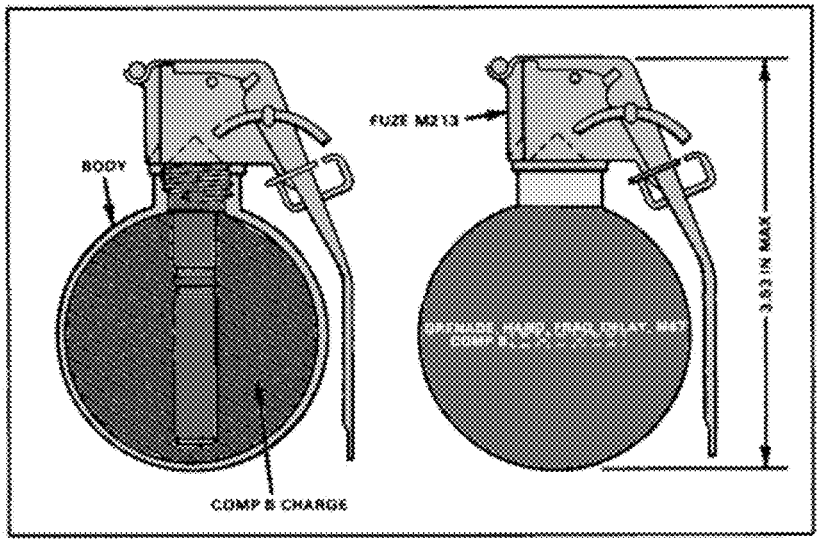
FIG. 1 (Prior Art)
FIG. 1 provides a prior art M67 Frag Grenade which the inventive sound projectile is intended to mimic in shape, size, weight and operation, but which can be employed without significant chance of injury during training exercises.

It should be clear that the description of the embodiments and attached Figures set forth in this specification serves only for a better understanding of the invention, without limiting its scope. It should also be clear that a person skilled in the art, after reading the present specification could make adjustments or amendments to the attached Figures and above described embodiments that would still be covered by the present invention

DETAILED DESCRIPTION

The following detailed description is merely exemplary in nature and is in no way intended to limit the scope of the invention, its application, or uses, which may vary. The invention is described with relation to the non-limiting definitions and terminology included herein. These definitions and terminology are not designed to function as a limitation on the scope or practice of the invention, but are presented for illustrative and descriptive purposes only.

As used herein a "sound generator" is an electronic device that when energized produces a sound event. The sound event generated may be of any frequency from audible to ultrasonic.

As used herein a "projectile" is a simulated device used in combat which detonates. Examples of projectiles include hand grenades, launched grenades, mortars, or a wide variety of command detonated or sensor detonated antipersonnel or antitank mines.

General

The present invention provides for devices and systems for providing interactive training projectiles to be used in a training environment which allow for the simulation of a blast event, and for the detection of trainee's physical distance from the origin of the blast (i.e. the blast radius) from the interactive training projectile when engaged. The use of the device and the system provide a means by which close combat indirect fire (mortars and grenade launchers) and hand grenades can be safely used in live training exercises. In addition, the use of the device and system provides reliable feedback for trainees who might be located in the small impact areas of these limited scale explosives.

Sound Projectile

The physical design of embodiments of the grenade and projectile consists of one or more of a skeleton core to affix one or more electronic sound generators, actuator buttons, setting buttons (for type of simulated grenade/projectile), audible and ultrasonic speakers, Light Emitting Diodes, wiring, one or more radio devices, and battery. For each embodiment, the electronics and core are surrounded by a more firm enclosure for protection. In some embodiment the projectile is further encased in soft shock proofing foam or other material to prevent injuries to trainees hit by the device when tossed or fired. The entire unit is intended to resemble the physical shape of the projectile device it replicates, and be operated in similar fashion as the real projectile.

Embodiments of the inventive projectile include at least one hollow spherical enclosure which is intended to be used for housing the electrical components of the projectile. In at least one embodiment, internal to the hollow spherical enclosure is at least one electronic sound generator having at least one speaker, at least one power supply, at least one timing circuit, and at least one actuating mechanism to engage said timing circuit to delay the activation of the at least one electronic sound generator upon actuating of the actuating mechanism. It is intended that upon the actuation of the actuating mechanism that the timing circuit is energized. When the timing circuit receives the desired, and pre-programmed timing to simulate the timing of the real projectile the training projectile is intended to imitate, that it will energize the sound generator to produce an audible sound which is simulation of a detonation. A sound generator also emits an ultrasonic sound upon detonation that is meant to communicate to an ultrasonic receiving device located upon the person of the trainee. The sound generator may also be augmented by a radio transmitter in order to emit a radio signal to the electronic receivers in the network so as to obtain an alternate time reference for calculating distance from blast origin.

It is appreciated that the timing circuit may be part of any actuating mechanism, power supply or sound generator. In at least one embodiment, the timing circuit is a separate circuit from any other circuit. In at least one embodiment, the timing circuit is included as part of the power supply, a control switch, actuating mechanism, sound generator, or combinations thereof. In at least one embodiment, the power supply contains at least one charging port where said hollow spherical enclosure is adapted such that said charging port may receive at least one plug from an external power source.

In at least one embodiment, in order to protect the electrical components from damage, the spherical enclosure of the inventive projectile is rigid. Furthermore, in some embodiments for the purpose of providing safety to the trainees in a training environment, the spherical enclosure is encased in a soft outer casing, including, without limit, an EVA foam case In at least one embodiment, the projectile further comprises at least one LED to accompany the sound transient from the sound generator.

It should be appreciated that simulation of actual devices are paramount to provide the most effective training. Thus, embodiments of the present invention include actuating mechanisms to simulate their real-life counterpart. In a non-limiting example where the inventive projectile is intended to simulate an M67 frag grenade, the actuating mechanism includes at least one safety clip, one cotter pin (aka "pull pin") or simulated cotter pin, and at least one mechanical lever (aka "spoon"). Similar to its real-life counter-part, the cotter pin holds the mechanical lever in place on the sound projectile, and upon removal of the cotter pin a user may activate the mechanical lever, which upon activation causes the actuation of a normally closed momentary switch to initiate the timing circuit.

It is appreciated that data from the sound transients may be useful in the training environment, thus in at least one embodiment, the inventive projectile includes at least one data generator internal for generating a data signal to provide a time stamp of the activation of the electronic sound generator. The data pulse is sent via radio signal and may be used to calculate many features, including without limit proximity to the blast device to determine the blast radius, and to be used by systems to determine whether a trainee (possessing a networked receiver device) has proximity to a simulated blast event and sufficient data to calculate if the blast would have missed, wounded or killed the trainee in the simulation, and report this event to the simulation system. The radio signal itself can either be embedded with a time stamp from the simulated grenade, or the signal's receipt by the radio receiver generates a time stamp at the networked device, obviating the need for a time stamp generator within the grenade.

It is appreciated that network communication with devices in a training environment is useful in order to provide real-time calculations and data aggregation. Thus certain embodiments of the inventive projectile of include at least one data communication device such as "Blue tooth" class radios, WIFI modules, "Zigbee" class radios, or other wireless communication to and from said projectile.

Other aspects include some embodiments having at least one accelerometer which may be used to calculate many parameters including a projectiles impact, a projectiles velocity, calculation of impact forces, and distance that the projectile traveled.

Figures 2A, 2B:
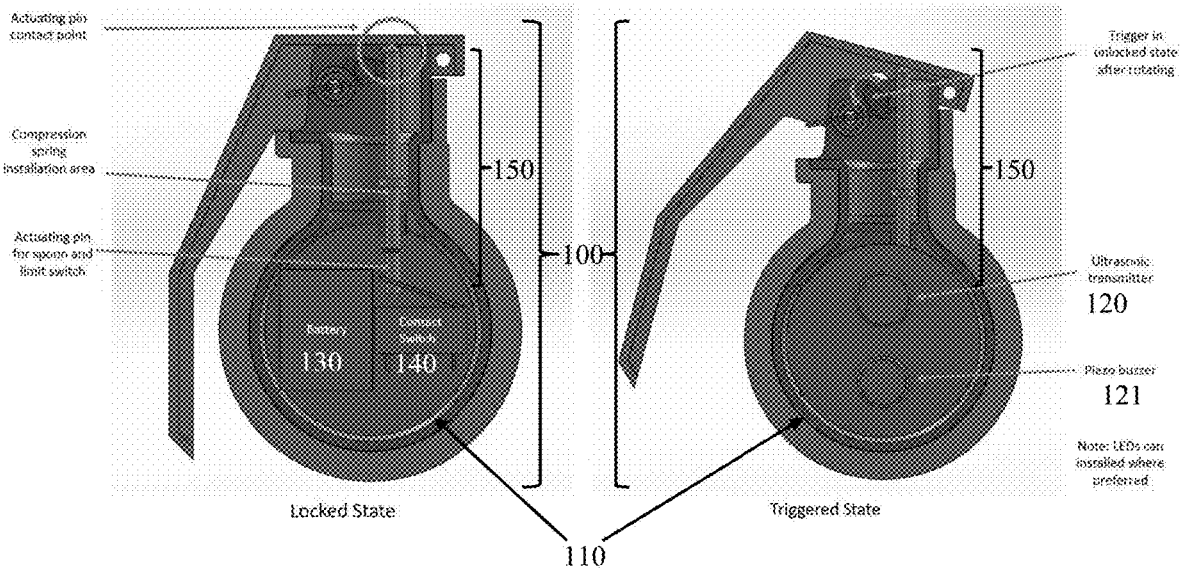
FIGS. 2A and 2B provides for a cutaway view of at least one embodiment of the inventive grenade illustrating the locked and triggered state off the inventive embodiment.

Turning to the figures, FIGS. 2A and 2B illustrates at least one embodiment of the inventive 100 sound projectile a 110 hollow spherical enclosure, 120 an electronic sound generator, a 130 power supply, an 150 actuating mechanism, and a 140 switch, as well as 121 a piezo buzzer. In this embodiment, when the inventive sound projectile is in a locked state, the 150 actuating mechanism has not been activated as illustrated in FIG. 2A. Upon activation of the sound projectile, the trigger is moved to an unlocked state actuating the actuating pin and overcoming the compression spring force to engage the actuating pin on the 140 contact switch. A timing circuit (not explicitly shown) is energized, and upon the expiration of time, the 120 an electronic sound generator is energized.

Figure 3:
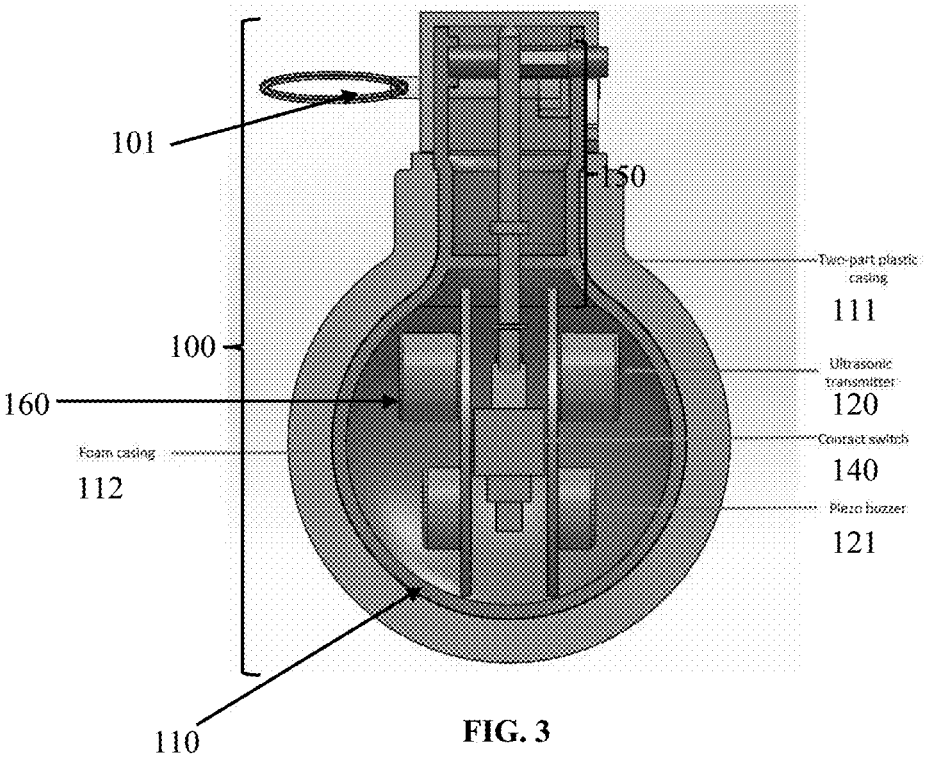
FIG. 3 provides for a front cutaway view of at least one embodiment of the inventive grenade.

FIG. 3 provides one embodiment of the inventive 100 sound projectile illustrating a 110 hollow spherical enclosure, 120 an electronic sound generator, an 150 actuating mechanism, a 140 switch, as well as 121 a piezo buzzer, 101 cotter pin for preventing inadvertent activation, 111 a plastic casing, 112 a foam coating, and 160 a radio module containing a radio transmitter in order to emit a radio signal. It should be appreciated that the sound generator, power supply, switch and/or radio module include a WIFI module for wireless communication to and from said 100 projectile, as well as data generator for generating a data signal via radio link to provide a data connection to a radio receiver and causing the time stamp of the activation of the electronic sound generator.

Figure 4:
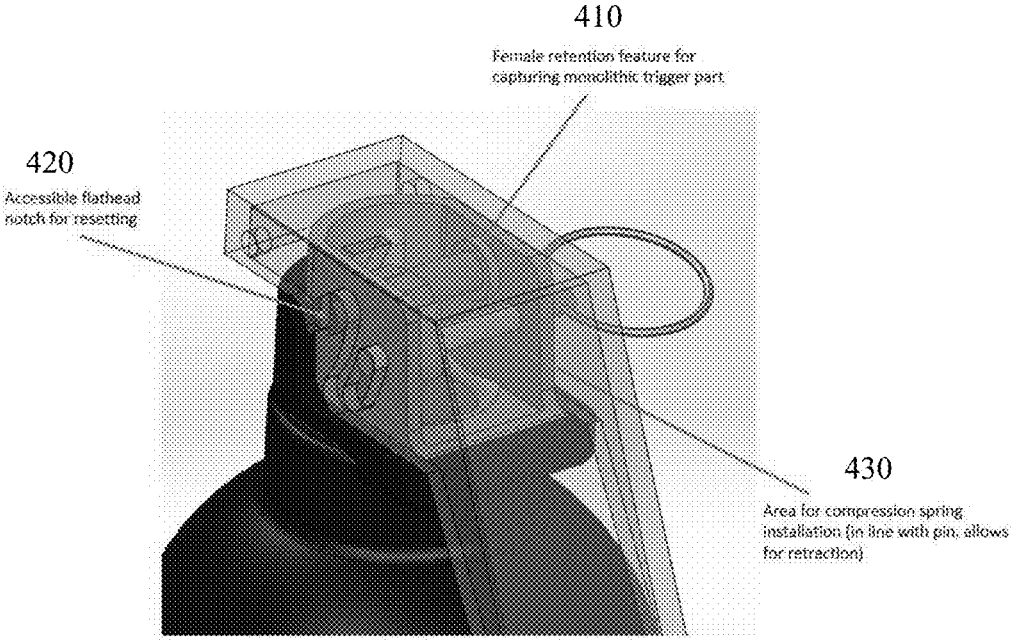
FIG. 4 provides for a blowup view of the activation mechanism of at least one embodiment of the inventive grenade.

Embodiments, including those illustrated in FIG. 4, may further include a 410 female retention feature for capturing monolithic trigger part, a 420 accessible flat head notch for resetting the 100 sound projectile after activation to return the 100 sound projectile to the locked state, and 430 and area for compression spring installation, which in this embodiment, is illustrated in line with a pin to allow for retraction.

System

The system proposes using audible and/or ultrasonic sound generators embedded in indirect fire training projectiles and training hand grenades to initiate sounds upon detonation, and in some embodiments generate time stamped data. In some embodiments the time stamped data is wirelessly transmitted from said projectile. In some aspects, each trainee in an exercise is outfitted with ultrasonic receivers and miniature processors which upon hearing the unique ultrasonic sound signature of a grenade or projectile also register a time stamp data string. In at least one aspect, a server which is processing data for the exercise records all time stamps of grenades/projectiles on the system to all the time stamps of receivers which were stimulated. Because the speed of sound is a known constant, as are the kill radius and wound radius of the grenades and projectiles, a simple comparison of time stamps will determine whether the trainee was standing in the kill or wounded blast radii of a grenade. In an alternate embodiment, an edge computer/processor is also located on the trainee such that timestamp data can be compared between the receipt of the ultrasonic sound and the data message receipt. A further embodiment uses the receipt of the radio signal itself from the grenade compared to the receipt of the ultrasonic or sonic sound which was simultaneously generated. Radio waves travel at the constant speed of light, and sound travels at constant (and much slower) sonic speeds, so the distance that the soldier-based receiver is from the origin of the simulated blast is easily calculated by the difference in time to receive the signals. The system will then send feedback to the trainee's feedback system and be registered in the exercise database.

Thus it is appreciated that the present invention provides for a system for evaluating proximity to a simulated blast event in a training environment. The system includes at least one sound projectile of any of the embodiments described herein which include at least one data generator for generating a data signal to provide a time stamp of the activation of the electronic sound generator of said inventive projectile, and at least one radio to send the data signal or stimulate a time stamp upon receipt.

Channelization of the radio signal is also used to further isolate the data signal and avoid confusion of the receiver from multiple data streams in near simultaneous detonation situations. Radios of the Zigbee class, or Bluetooth class, WIFI module, or combination of wireless communicators may be implemented, but the invention is not limited to these current wireless classifications.

The system further includes at least one sound receiver containing at least one microphone and possibly one data generator for detecting the activation of the sound generator and generating a time stamp of said activation. If no data generator is utilized, a radio signal can stimulate a time stamp or time record at the trainee-based electronic receiver/processor. Finally the system includes at least one computing device for comparing the time stamp generated by the sound projectile to the time stamp generated by the sound receiver and calculating the distance of said sound receiver from said sound generator at the time of the sound generator activation.

As provided earlier, it is appreciated that real-time data computation and aggregation enhances training effectiveness, especially for providing live feedback to a trainee. Thus in at least one embodiment of the system the sound receiver includes at least one wireless radio module for wireless communication to and from said receiver. It should be understood that implicit with a wireless module, a wireless network is used. It should be further appreciated that other wireless communication devices may be used such as Radio Frequency Identification (RFID) modules paired with RFID readers, cellular transmitters, WIFI, or Bluetooth may be used in place of the wireless module, and nothing herein is intended for the wireless communications to be limited only to one network type.

In at least one embodiment, the system further includes at least one computing device for receiving time stamp information from the sound/radio projectile and the sound/radio receiver and determines whether the sound/radio receiver was within a kill zone or wound zone relative to the sound/radio projectile and provides an indication that a user of the sound/radio receiver was wounded or killed as a result of their proximity to the activation of the sound/radio projectile.

Figure 5:
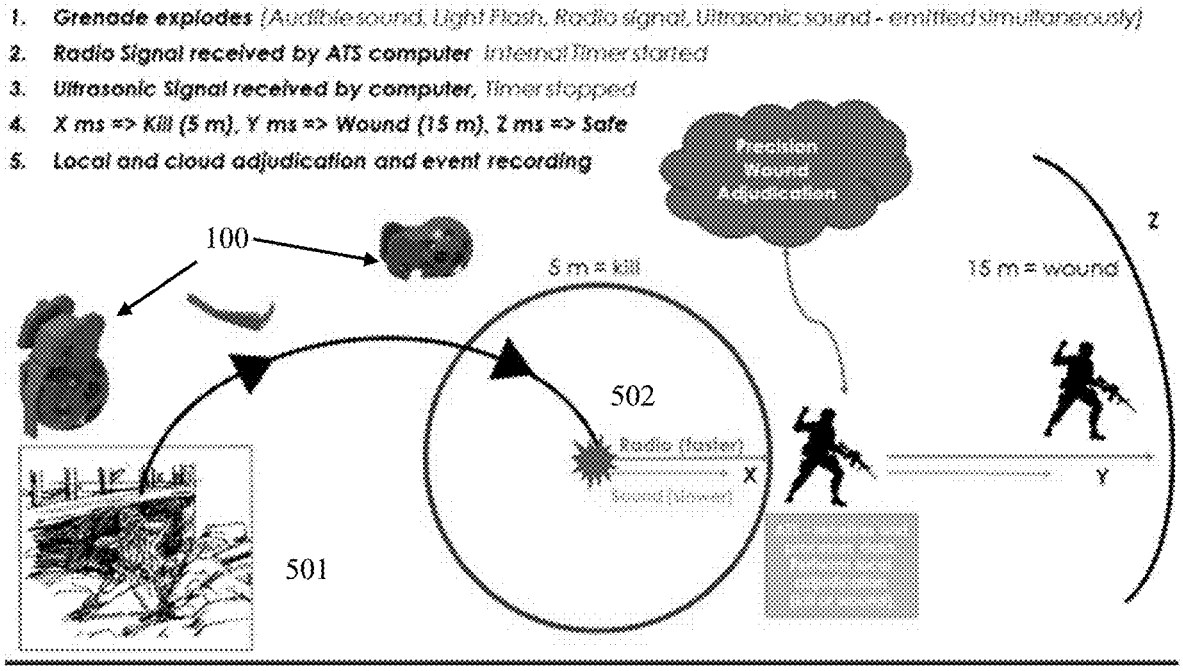
FIG. 5 illustrates one embodiment of the inventive method.

Turning to the figures, FIG. 5 illustrates one embodiment of the inventive system and method. FIG. 5. Illustrates 501 a participant actuating and throwing the 100 sound projectile, upon the expiration of the timer, the projectile, simulating explosion, is 502 activated whereby an audible sound (via piezo buzzer), light flash, radio signal (and WIFI communication of data), and ultrasonic sound is emitted simultaneously. The radio signal is received by a computer and a timer is started. Then the ultrasonic signal is received by the computer, and the time is stopped. The computer based on the timing measured, and location of personnel, receives and processes the data and performs local adjudication of health and mortality (killed or wounded) of a participant within a blast zone of the sound projectile, simulating the effects of a grenade in combat.

Other Embodiments

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

The invention claimed is:

1. A projectile for use in a training environment, the projectile comprising:

a hollow nearly spherical grenade-like enclosure;

at least one electronic sound generator having at least one speaker, wherein said at least one electronic sound generator is internal to said hollow spherical enclosure;

at least one power supply internal to said hollow spherical enclosure, wherein said power supply contains at least one charging port where said hollow spherical enclosure is adapted such that said charging port may receive at least one plug from an external power source;

at least one actuating mechanism to engage said sound generator upon actuating of the actuating mechanism;

at least one timing circuit to delay activation of said sound generator upon actuating of the actuating mechanism; and at least one data generator internal to said hollow grenade-like nearly spherical enclosure for generating a data signal via radio link to provide a data connection to a radio receiver and causing the time stamp of the activation of the electronic sound generator;

wherein upon actuating said actuating mechanism of said projectile, said at least one timing circuit is energized by said power supply, and wherein upon completion of said timing circuit said electronic sound generator is energized and said data generator simultaneously generates a data signal having a time stamp.

2. The projectile of claim 1 wherein said enclosure is rigid, has a skeleton for electronics mounting, and has padding or other energy dissipating materials for the safety of trainees from projectile injuries.

3. The projectile of claim 1 further comprising one or more LED's, wherein said one or more LED's are activated along with said electronic sound generator.

4. The projectile of claim 1 wherein said actuating mechanism includes at least one cotter pin, simulated cotter pin, and at least one mechanical lever, wherein said pin holds said mechanical lever in place on said sound projectile, and wherein upon removal or engagement of the cotter pin a user may activate a mechanical lever, which upon activation causes the actuation of a normally closed momentary switch, connected to the electronics in the interior of the projectile.

5. The projectile of claim 1 further comprising at least one radio or WIFI module internal to said hollow spherical enclosure for wireless communication to and from said projectile.

6. The projectile of claim 1 further comprising an energy dissipating material case surrounding said hollow spherical enclosure.

7. The projectile of claim 1 further comprising at least one accelerometer.

8. A system for evaluating proximity to a simulated blast event in a training environment, the system comprising:

at least one sound projectile of claim 1 having at least one data generator for generating a data signal to provide a time stamp of the activation of the electronic sound generator or providing a time stamp at the receiver of the radio signal;

at least one sound receiver containing at least one microphone and at least one data generator for detecting the activation of the sound generator and generating a time stamp of said activation; and at least one computing device for comparing the time stamp generated by the sound projectile's data generator time stamp to the time stamp generated by the sound receiver, or comparing the receipt time of a radio transmission to the receipt time of the sound signal, thereby calculating the distance of said sound receiver from said sound generator at the time of the sound generator activation using the tie stamp generated by the data generator.

9. The system of claim 8 wherein said sound receiver further comprises at least one radio or WIFI module or other wireless device for wireless communication to and from said receiver.

10. The system of claim 8 wherein said computing device (at the system or server level, or at the trainee's processor level) determines adjudication of the training situation as to whether the sound receiver was within a kill zone or wound zone relative to the sound projectile and providing an indication that a user of the sound receiver was wounded or killed in either event.

11. The system of claim 8 wherein said computing device and wireless communication relaying the calculation of wounding or killing to the overall exercise control system and/or to the trainee's individual feedback system.

* * * * *